US012029948B2

(12) United States Patent
Kanemitsu et al.

(10) Patent No.: US 12,029,948 B2
(45) Date of Patent: Jul. 9, 2024

(54) GOLF CLUB HEAD

(71) Applicant: Sumitomo Rubber Industries, Ltd., Hyogo (JP)

(72) Inventors: Yumi Kanemitsu, Kobe (JP); Naruhiro Mizutani, Kobe (JP); Hirotaka Nakamura, Kobe (JP); Yuki Motokawa, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 70 days.

(21) Appl. No.: 17/815,921

(22) Filed: Jul. 28, 2022

(65) Prior Publication Data

US 2023/0056990 A1 Feb. 23, 2023

(30) Foreign Application Priority Data

Aug. 18, 2021 (JP) ..... JP2021-133638

(51) Int. Cl.
*A63B 53/04* (2015.01)

(52) U.S. Cl.
CPC ..... *A63B 53/0466* (2013.01); *A63B 53/0408* (2020.08); *A63B 2209/02* (2013.01)

(58) Field of Classification Search
CPC ..... A63B 2209/02; A63B 53/0437
See application file for complete search history.

(56) References Cited

U.S. PATENT DOCUMENTS 6,955,612 B2 * 10/2005 Lu ..... A63B 53/0466 473/409
7,252,599 B2 * 8/2007 Hasegawa ..... A63B 53/0466 473/347
7,281,993 B2 * 10/2007 Oyama ..... A63B 53/0466 264/572
7,371,191 B2 * 5/2008 Sugimoto ..... A63B 53/0466 473/345
7,431,664 B2 * 10/2008 Meyer ..... A63B 60/42 473/332
7,435,190 B2 * 10/2008 Sugimoto ..... A63B 53/0466 473/345

(Continued)

FOREIGN PATENT DOCUMENTS

JP 2020-043945 A 3/2020

OTHER PUBLICATIONS

International Journal of Adhesion and Adhesives, Da Silva, Lucus, Effect of Grooves on the Strength of Adhesively Bonded Joints, https://pdf.sciencedirectassets.com/271565/1-s2.0-S0143749610X00070/1-s2.0-S0143749610000977/main.pdf?X-Amz-Security-Token=IQoJb3JpZ2, 2010.*

*Primary Examiner* — William M Pierce
(74) *Attorney, Agent, or Firm* — Studebaker & Brackett PC

(57) ABSTRACT

A golf club head includes a metallic head body having an opening, and an FRP member fixed to the head body so as to close the opening. The FRP member is a fiber-reinforced plastic including fibers and thermoplastic resin. The head body includes a support portion around the opening. The support portion has a first surface for supporting the FRP member. The first surface is provided with at least one narrow groove having a groove width of 20 to 80 μm and a groove depth of 100 to 400 μm, and a part of the thermoplastic resin of the FRP member is solidified inside the at least one narrow groove.

16 Claims, 7 Drawing Sheets

(56) References Cited

U.S. PATENT DOCUMENTS

| | | | | |
|---|---|---|---|---|
| 7,479,070 | B2 * | 1/2009 | Hirano | A63B 60/52 473/345 |
| 7,699,719 | B2 * | 4/2010 | Sugimoto | A63B 53/0466 473/345 |
| 8,801,542 | B2 * | 8/2014 | Sugimoto | A63B 53/0466 473/316 |
| 8,961,335 | B2 * | 2/2015 | Sugimoto | A63B 53/0466 473/332 |
| 9,925,432 | B2 * | 3/2018 | Morales | A63B 53/0466 |
| 10,369,428 | B2 * | 8/2019 | Motokawa | A63B 53/0466 |
| 10,583,334 | B2 * | 3/2020 | Martens | A63B 53/0408 |
| 10,828,543 | B2 * | 11/2020 | Morales | A63B 53/0475 |
| 11,077,340 | B2 * | 8/2021 | Martens | A63B 53/0433 |
| 11,213,729 | B2 * | 1/2022 | Aramaki | A63B 53/0437 |
| 11,439,876 | B1 * | 9/2022 | Sasamoto | A63B 53/0466 |
| 11,701,557 | B2 * | 7/2023 | Greensmith | A63B 53/0454 473/345 |
| 2004/0192468 | A1 * | 9/2004 | Onoda | A63B 53/0466 473/345 |
| 2005/0159243 | A1 * | 7/2005 | Chuang | A63B 53/0466 473/345 |
| 2005/0272527 | A1 * | 12/2005 | Sugimoto | A63B 53/0466 473/345 |
| 2020/0086184 | A1 | 3/2020 | Motokawa et al. | |
| 2020/0391087 | A1 * | 12/2020 | Su | A63B 53/0429 |
| 2023/0056990 | A1 * | 2/2023 | Kanemitsu | A63B 53/0437 |

* cited by examiner

GOLF CLUB HEAD

RELATED APPLICATIONS

This application claims the benefit of foreign priority to Japanese Patent Application No. JP2021-133638, filed Aug. 18, 2021, which is incorporated by reference in its entirety.

FIELD OF THE DISCLOSURE

The present disclosure relates to a golf club head.

BACKGROUND OF THE DISCLOSURE

A golf club head in which an FRP member made of fiber reinforced plastic is used for the crown and/or the sole have been proposed. Using the FRP member, the weight of the crown and/or sole may be reduced. The weight reduced by the crown and/or sole can help to provide a discretionary weight margin that can be used to optimize the position of the center of gravity of the head, the moment of inertia, and the like.

PATENT DOCUMENT

[Patent document 1] Japanese Unexamined Patent Application Publication 2020-43945

SUMMARY OF THE DISCLOSURE

The golf club head as described above is required to secure sufficient bonding strength between the metallic head body and the FRP member. In addition, golf club heads using an FRP member may have a problem that the striking sound do not reverberate for a long time.

The present disclosure has been made in view of the above circumstances and has a major object to provide a golf club head that can make the striking sound reverberate for a long time while realizing high joint strength between a metallic head body and an FRP member.

In one aspect of the present disclosure, a golf club head includes a metallic head body having an opening, and an FRP member fixed to the head body so as to close the opening. The FRP member is a fiber-reinforced plastic including fibers and thermoplastic resin. The head body includes a support portion around the opening. The support portion has a first surface for supporting the FRP member. The first surface is provided with at least one narrow groove having a groove width of 20 to 80 μm and a groove depth of 100 to 400 μm, and a part of the thermoplastic resin of the FRP member is solidified inside the at least one narrow groove.

DETAILED DESCRIPTION OF THE DISCLOSURE

Figure 1:
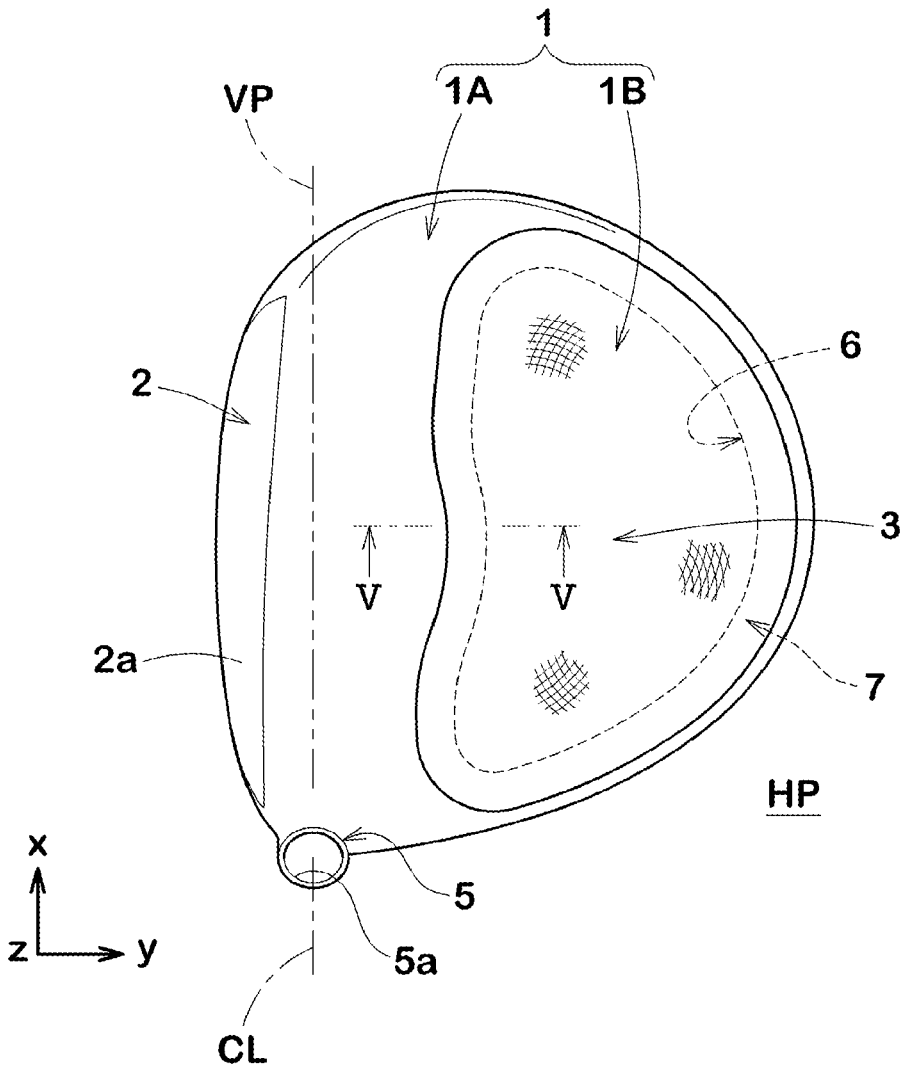
FIG. 1 is a plan view showing an embodiment of a golf club head.

Hereinafter, one or more embodiments of the present disclosure will be described with reference to the drawings. Note that the drawings contain representations that differ from the dimensional ratios of the actual structure to aid in the understanding of the present disclosure. Further, throughout the specification, the same or common elements are given the same reference numerals, and duplicate explanations are omitted. Furthermore, the specific configurations shown in the embodiments and drawings are for understanding the contents of the present disclosure, and the present disclosure is not limited to the specific configurations shown.

Figure 2:
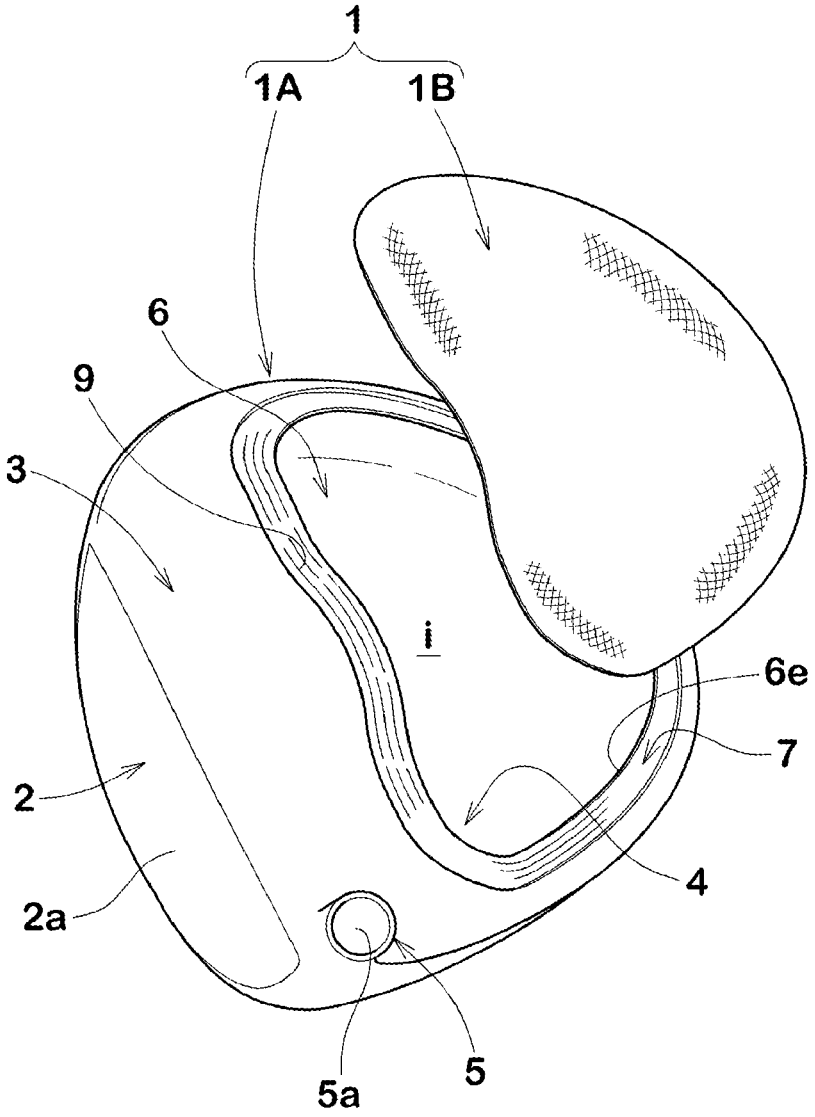
FIG. 2 is an exploded perspective view of the golf club head.

FIG. 1 is a plan view showing an embodiment of a golf club head (hereinafter, may be simply referred to as "head") 1, and FIG. 2 is an exploded perspective view of the head 1. In FIG. 1, the head 1 is in a reference state.

[Reference State of Head]

As used herein, the "reference state" of the head 1 means that the head 1 is placed on a horizontal plane HP with its lie angle and the loft angle of the head 1. The loft angle and lie angle are usually specified in product catalogs and the like. In the reference state, the virtual shaft axis centerline CL of the head 1 is arranged within a reference vertical plane VP perpendicular to the horizontal plane HP. The "virtual shaft axis centerline CL" is defined by the axis centerline of a shaft insertion hole 5*a* formed in a hosel 5 of the head 1. Unless otherwise noted herein, the head 1 is under the reference state.

[Direction of Head]

As used herein, three directions are associated with the head 1 in the reference state. First, the direction x parallel to the horizontal plane HP and the vertical plane VP is defined as the toe-heel direction of the head 1. The direction y orthogonal to the vertical plane VP is the front-back direction of the head 1. In the front-back direction of the head, a club face 2 side is the front side, and the opposite side is the rear side (also called the back side). Further, the direction z orthogonal to both the above directions x and y is defined as the head vertical direction.

[Basic Structure of Head]

The head 1 according to the present embodiment, for example, is configured as a wood-type golf club head. Such a wood-type golf club head includes, for example, a driver (#1) as well as fairway woods. In another embodiment, the head 1 may be configured as a utility type or hybrid, for example.

The head 1, for example, includes the club face 2, a crown 3, a sole 4 and the like. In the present embodiment, the head 1 also includes a hollow portion i therein. A part of the hollow portion i may be filled with a foaming agent, a gel agent, or the like, for example.

[Club Face]

The club face 2 is a part for striking a ball and is formed on the front side of the head 1. The outer surface (front surface) of the club face 2 constitutes a striking face 2*a* that comes into contact with a ball. Although not shown, the striking face 2*a* may be provided with a plurality of grooves extending in the toe-heel direction called face lines.

[Crown]

The crown 3 extends from an upper edge of the club face 2 to the rear of the head so as to form an upper surface of the head 1. The crown 3, for example, forms a portion excluding the club face 2 and the hosel 5 in a head plan view shown in FIG. 1. The hosel 5 is provided on the heel side of the crown 3.

[Sole]

The sole 4 extends from a lower edge of the club face 2 to the rear of the head so as to form a bottom surface of the head 1. The sole 4, for example, forms a portion excluding the hosel 5 in a head bottom view.

Figure 3:
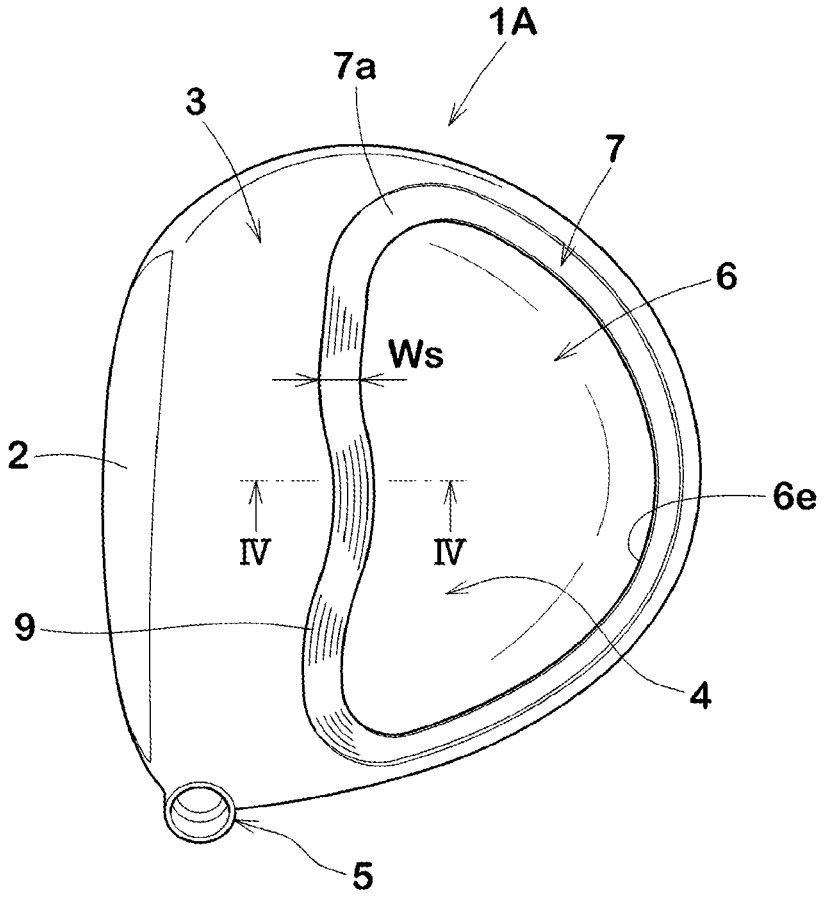
FIG. 3 is a plan view of the golf club head in the state before an FRP member is fixed.
Figure 4:
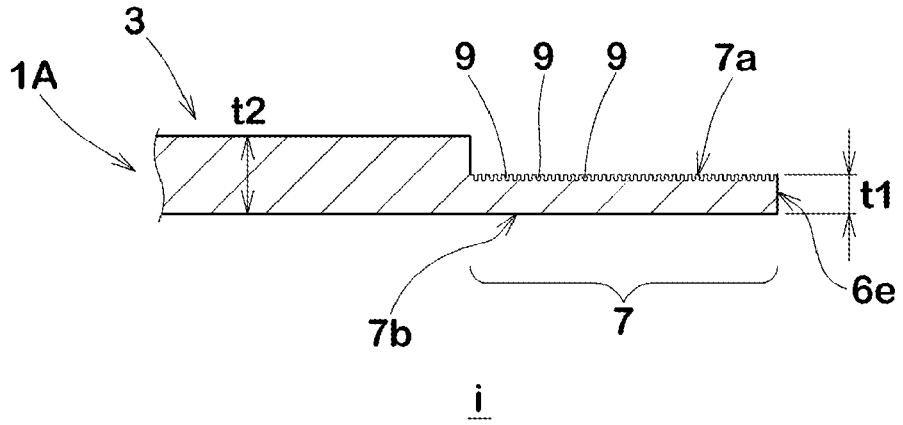
FIG. 4 is a cross-sectional view taken along the lines IV-IV of FIG. 3.
Figure 5:
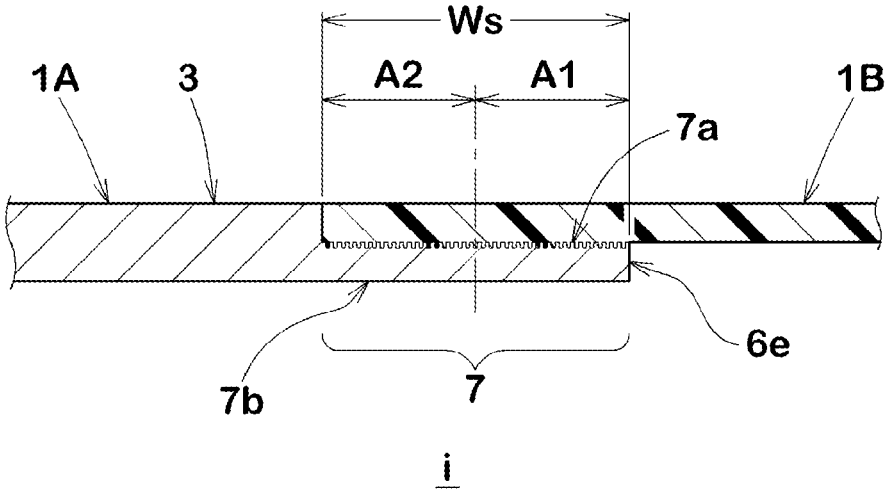
FIG. 5 is a cross-sectional view taken along the lines V-V of FIG. 1.

In the present embodiment, the head 1 includes a metallic head body 1A having an opening 6, and an FRP member 1B fixed to the head body 1A so as to close the opening 6. FIG. 3 is a plan view of the head body 1A, FIG. 4 is a cross-sectional view taken along the lines IV-IV of FIG. 3, and FIG. 5 is a cross-sectional view taken along the lines V-V of FIG. 1.

[Head Body]

The metal material constituting the head body 1A is not particularly limited, but for example, one or more of stainless steel, maraging steel, titanium alloy, aluminum alloy, magnesium alloy and the like may be suitable. The head body 1A according to the present embodiment is entirely made of a titanium alloy, for example.

Referring to FIGS. 1 to 3, the head body 1A according to the present embodiment, for example, is provided with the opening 6 on the crown 3. Specifically, the head body 1A according to the present embodiment includes portions other than the opening 6, e.g., including the club face 2, the sole 4, hosel 5, and the crown 3. Such a head body 1A may be integrally formed in advance, or may be formed by joining two or more parts.

As illustrated in FIG. 2 and FIG. 3, the opening 6 penetrates the head body 1A and communicates with the hollow portion i. In this embodiment, the contour edge 6*e* of the opening 6 is contained in the crown 3. In other embodiments, the contour edge 6*e* of the opening 6 may extend beyond the crown 3, and the opening 6 may be provided on another location other than the crown 3 which will be described later.

As illustrated in FIG. 3 and FIG. 4, the head body 1A includes a support portion 7 around the opening 6, and the support portion has a first surface 7*a* for supporting the FRP member 1B. A peripheral edge region of the FRP member 1B is overlapped and fixed to the support portion 7. The support portion 7 according to the present embodiment is formed continuously so as to surround the opening 6, for example. In other embodiments, the support portion 7 may be intermittently formed around the opening 6.

Figure 6:
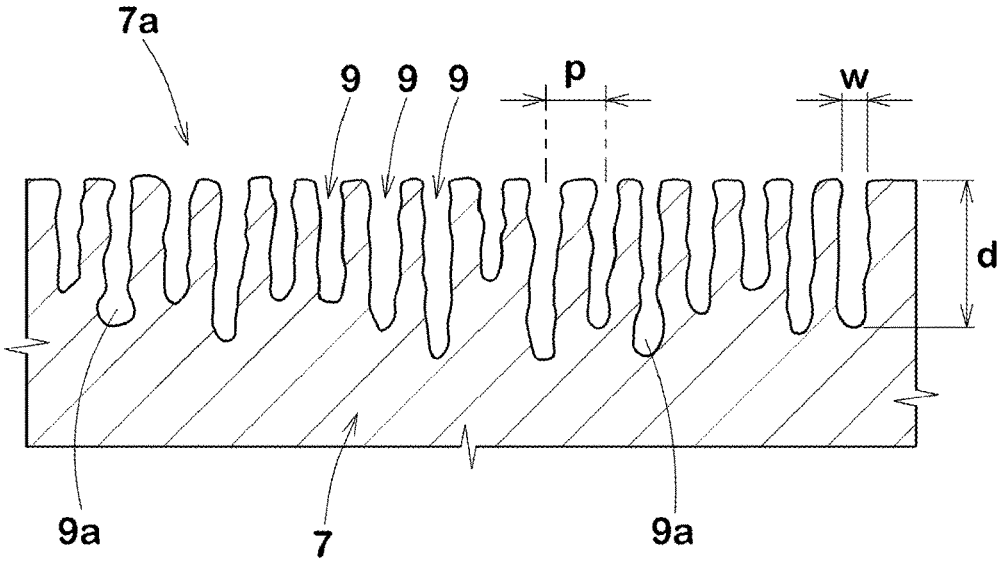
FIG. 6 is an enlarged view of a main portion of the first surface in FIG. 4.

The support portion 7 includes the above-mentioned first surface 7*a* facing the FRP member 1B side and a second surface 7*b* on the opposite side. FIG. 6 is an enlarged view of a main part of the first surface 7*a*. As illustrated in FIG. 4 and FIG. 6, the first surface 7*a* is provided with at least one narrow groove 9. In this embodiment, a plurality of narrow grooves 9 is formed on the first surface 7*a*.

The narrow grooves 9 have groove widths w in a range from 20 to 80 μm, and groove depths d in a range from 100 to 400 μm. The first surface 7*a* may be provided with one or more narrow grooves that do not satisfy the above dimensions, but in this case, it is preferable that most of the narrow grooves meet the above dimensions.

[FRP Member]

In this embodiment, the FRP member 1B is made of a fiber reinforced plastic (CFRTP) containing fibers and thermoplastic resin. The FRP member 1B has a specific gravity smaller than that of the head body 1A. Thus, in the head 1 of the present embodiment, since a part of the crown 3 is formed by the FRP member 1B, the upper part of the head is lightened, and the center of gravity of the head 1 can be positioned lower, for example. In addition, the weight reduced by the crown 3 may be used as a discretionary weight margin to optimize the moment of inertia of the head 1, for example.

Figure 7:
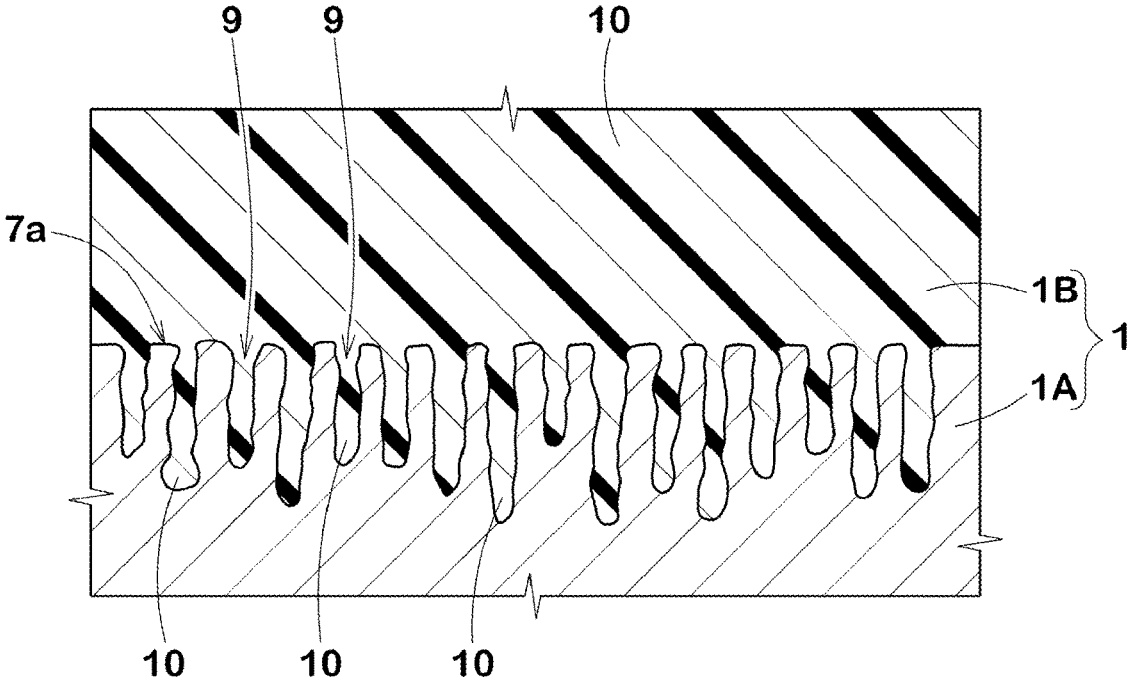
FIG. 7 is an enlarged view of a main portion of the boundary between a support portion and the FRP member in FIG. 5.

In the present embodiment, the FRP member 1B, for example, is formed in a plate shape as a whole, and its peripheral edge portion is joined to the first surface 7*a* of the support portion 7 of the head body 1A. As illustrated in FIG. 7, a part of the thermoplastic resin 10 of the FRP member 1B is solidified inside some or all the narrow grooves 9 of the first surface 7*a*. In this embodiment, the thermoplastic resin 10 is solidified inside the narrow grooves 9 so as to fill substantially the entire space of the narrow grooves 9.

In this embodiment, no adhesive intervenes between the FRP member 1B and the first surface 7*a*. That is, the first surface 7*a* (including the narrow grooves 9) of the support portion 7 and the FRP member 1B are in direct contact with each other.

[Effect of Embodiment (Degree of Bonding)]

In the head 1 according to the present embodiment, a part of the thermoplastic resin of the FRP member 1B is solidified inside the narrow grooves 9 with a specific groove widths and depths formed on the first surface 7*a* of the support portion 7. Thus, the FRP member 1B can be firmly joined to the support portion 7 by the so-called "anchor effect".

In order to quantitatively determine the bond strength between the head body 1A and the FRP member 1B, the inventors conducted bond strength tests in accordance with JIS-K6850 "Testing Method for Tensile Shear Bond Strength of Adhesively Bonded Materials".

First, a test specimen 1 corresponding to an example was prepared. The test specimen 1 consists of a plate made of 6-4 titanium alloy with a plurality of narrow grooves formed, and an FRP member (100 mm×25 mm×1 mm, fiber direction is 0 degrees with respect to the longitudinal direction) consisting of carbon fibers and polyphenylene sulfide (PPS) as a thermoplastic resin were joined. Both members were joined by contacting the FRP member to the degreased plate without the intervention of adhesive and heating at 330 degrees C. for 30 minutes while pressing at a pressure of 3.5 MPa. The joined area was 12.5 mm×25 mm. The specifications of the narrow grooves and the groove depths on the surface of the plate were as follows.

Groove widths: 30 to 71 μm

Groove depths: 230 to 250 μm

Spacing of grooves: 0.083 mm (average value)

Number of grooves: 150

Longitudinal direction of the narrow groove: perpendicular to the direction of tensile shear In addition, a test specimen 2 corresponding to a comparative example was also prepared. The test specimen 2 consists of the above 6-4 titanium alloy degreasing plate and the above the FRP member. No narrow grooves were formed on the surface of the plate. The surface of the plate was pre-blasted with 100 m blast materials. Test specimen 2 was bonded by an epoxy-based adhesive (DP420 manufactured by 3M) between the degreased plate and the FRP member in the same manner as above.

Next, a bond strength test was conducted in accordance with JIS-K6850. The tensile test speed was 10 mm/min. As a result of the test, the bond strength of the test specimen 2 was 4 MPa, while the bond strength of the test specimen 1 was 20 MPa, which was five times that. This confirmed the remarkable superiority of test material 1. Those skilled in the art would appreciate that the high bond strength verified with this test material 1 can be obtained for golf club heads as well.

[Effect of Embodiment (Striking Sound)]

The thermoplastic resin of the FRP member 1B of the present embodiment tends to have a smaller vibration damping coefficient (damping ratio) than that of thermosetting resin. Thus, when a ball is struck, the vibration damping effect of the FRP member 1B can be suppressed, and the striking sound can be reverberated for a long time.

In conventional heads of this type, epoxy-based or acrylic-based adhesives have been used to bond a metal body to an FRP member. However, these adhesives not only do not provide sufficient adhesive strength with the thermoplastic resin, but also tend to attenuate the vibration of the head when striking a ball. In the present embodiment, since no adhesive is interposed between the FRP member 1B and the support portion 7, the vibration characteristics of the head 1 can be improved and the striking sound can be reverberated longer.

The inventors conducted a vibration characteristic test using the above test specimens 1 and 2 in order to quantitatively understand the effect of sustaining the striking sound. In the vibration characteristic test, a triangular jig (contact tip) was fixed to the plate side of the titanium alloy of each test specimen with instant adhesive and attached to the exciter. Then, the anti-resonance peak was analyzed in the servo mode. Specifically, the damping (damping ratio) of the anti-resonance peak in the range of about 2000 to 4000 Hz, which is related to the sustainability of the striking sound of the golf club head, was obtained. The smaller the damping ratio, the longer the vibration will last.

As a result of the vibration characteristic test, it was confirmed that the damping of the test specimen 2, which corresponds to the configuration of the conventional head, was about 0.8% to 0.9%, while that of the test specimen 1, which corresponds to the example, was reduced to 0.2% to 0.4%, which is less than half of that. This confirms the significant superiority of the test specimen 1. Those skilled in the art will understand that the vibration characteristics (vibration persistence) verified by this test specimen 1 function in the golf club head to make the sound of striking the ball resonate for a long time.

As described above, the head 1 according to the present embodiment can make the striking sound reverberate for a long time while realizing a high joint strength between the head body 1A made of metal and the FRP member 1B.

[Preferable Embodiment of Support Portion]

In order to further enhance the anchor effect described above, the groove depths d of the narrow grooves 9 are more preferably equal to or more than 100 μm, still more preferably equal to or more than 200 μm. On the other hand, if the groove depths d of the narrow grooves 9 becomes too large, the permeability of the thermoplastic resin deteriorates and the strength of the support portion 7 may decrease. From this point of view, the groove depths d of the narrow grooves 9 are more preferably equal to or less than 400 μm, still more preferably equal to or less than 300 μm.

In order to further enhance the anchor effect described above, the groove widths w of the narrow grooves 9 are more preferably equal to or less than 80 μm, more preferably equal to or less than 60 μm, and the narrow grooves 9 be preferably made finer. On the other hand, if the groove widths w of the narrow grooves 9 become too small, the permeability of the thermoplastic resin into the narrow grooves 9 may deteriorate. From this point of view, the groove depths d of the narrow grooves 9 are more preferably equal to or more than 20 μm, still more preferably equal to or more than 40 μm.

As illustrated in FIG. 6, the narrow grooves 9 may include at least one, preferably a plurality of first narrow grooves 9*a* in which a groove width on a groove bottom side is greater than a groove width on the inlet side in the groove depth direction. This can further improve the anchor effect.

Distances p (distances between the directly adjacent centers of the grooves) of the narrow grooves 9 are not particularly limited, but if it becomes too small, the strength of the support portion 7 may decrease. From this point of view, the distances p of the narrow grooves 9 are preferably equal to or more than 0.04 mm, more preferably equal to or more than 0.06 mm, even more preferably equal to or more than 0.08 mm. On the other hand, if the distances p of the narrow grooves 9 become large, the anchor effect may decrease. From this point of view, the distances p of the narrow grooves 9 are preferably equal to or less than 0.5 mm, more preferably equal to or less than 0.2 mm, even more preferably equal to or less than 0.1 mm. Considering the workability of the narrow grooves 9, the distances p do not have to be constant and may be non-constant.

The extension orientation of the narrow grooves 9 is not particularly limited, but the plurality of narrow grooves 9 of the present embodiment extends along the contour edge 6*e* of the opening 6, as shown in FIG. 2 and FIG. 3. In this case, the plurality of narrow grooves 9 may be arranged concentrically or spirally. Further, a length of the narrow grooves 9 may be appropriately determined as long as it is equal to or larger than the groove width. In this embodiment, the narrow grooves 9 are continuous in a substantially loop shape along the contour edge 6*e* of the opening 6. In another embodiment, the narrow grooves 9 do not have to be continuous, and may be configured as short straight-line shapes or curved-line shapes. There may be gaps between the ends of the adjacent narrow grooves 9, or the narrow grooves 9 may intersect with one another. Further, the narrow grooves 9 may be bent in the middle.

In general, when a ball is struck with the head 1, a shear force in the direction orthogonal to the contour edge 6*e* of the opening 6 tends to act between the first surface 7*a* of the support portion 7 and the FRP member 1B. Thus, by aligning the narrow groove 9 along the contour edge 6*e* of the opening 6, the deformation resistance to the above-mentioned shearing force can be enhanced at the joint. As a result, even when striking the ball repeatedly, the decrease in bond strength can be suppressed.

As illustrated in FIG. 4, a thickness t1 of the support portion 7, for example, is preferably smaller than a thickness t2 at a position other than the support portion 7 adjacent to the support portion 7. Thus, the crown 3 may further be lightened, lowering the center of gravity of the head, and providing a greater discretionary weight margin. In some preferred embodiments, a thickness t1 of the support portion 7, for example, is equal to or less than 1.2 mm, more preferably equal to or less than 1.1 mm, still more preferably equal to or less than 1.0 mm. On the other hand, if the thickness t1 of the support portion 7 becomes excessively small, the strength may decrease. From this point of view, the thickness t1 of the support portion 7, for example, is equal to or more than 0.5 mm, more preferably equal to or more than 0.6 mm, more preferably equal to or more than 0.7 mm.

As illustrated in FIG. 4, in the support portion 7 according to the present embodiment, the first surface 7*a* is recessed from an outer surface of the head (the outer surface other than the support portion 7 adjacent to the support portion 7) to the contour edge 6*e* of the opening 6. The support portion 7 according to the present embodiment is recessed in a step like manner from the outer surface of the head. The support portion 7 can absorb the thickness of the FRP member 1B when the FRP member 1B is superimpose on it, as shown in FIG. 5, and helps to reduce or eliminate the formation of a step on the outer surface of the head 1.

As illustrated in FIG. 3 and FIG. 5, the support portion 7 has a support width Ws measured in the direction orthogonal to the contour edge 6*e* of the opening 6. In the head according to the present embodiment, since the bond strength between the support portion 7 and the FRP member 1B is high, it is possible to reduce the support width Ws and obtain a further weight margin. In order to obtain a larger weight margin while sufficiently maintaining the bond strength, the support width Ws is preferably equal to or more than 3 mm, more preferably equal to or more than 5 mm, still more preferably equal to or more than 7 mm, but preferably equal to or less than 13 mm, more preferably equal to or less than 11 mm, still more preferably equal to or less than 9 mm.

As illustrated in FIG. 5, when the first surface 7*a* is virtually divided into a first region A1 on a contour edge 6*e* side of the opening 6 and a second region A2 outside the first region A1 by a width center line that divides the support width Ws into two equal parts, an arrangement density of the narrow grooves 9 in the second region A2 is smaller than an arrangement density of the narrow grooves 9 in the first region A1. The second region A2 of the support portion 7 (i.e., a root side of the support portion 7) tends to receive a relatively larger bending moment. Thus, by making the arrangement density of the narrow grooves 9 relatively small in the second region A2, the durability against bending deformation of the support portion 7 can be improved. With this, the support portion 7 can be made thinner and lighter.

[Preferable Aspect of FRP Member]

As the thermoplastic resin of the FRP member 1B, for example, nylon (PA), polypropylene (PP), polyphenylene sulfide (PPS), polyethersulfone (PES), polyetherimide (PEI), polycarbonate (PC), polyether terephthalate (PET), polyetherketone (PEK), polyetheretherketone (PEEK), polyetherketoneketone (PEKK), phenoxy resin and the like may be employed. In particular, polyphenylene sulfide (PPS), polyetherimide (PEI), polyethersulfone (PES), polyetheretherketone (PEEK), phenoxy resin, etc., which have a small attenuation ratio, may be suitable.

[Manufacturing Method of Head of Embodiments]

The head 1 according to the present embodiment may be manufactured including a first step of preparing the head body 1A, a second step of preparing the FRP member 1B, and a third step of pressurizing and heating these overlapping portions.

In the first step, the narrow grooves 9 can be formed on the trajectory of a laser beam by irradiating the first surface 7*a* of the support portion 7 while moving the continuous wave laser beam in a predetermined pattern, for example. The groove widths w and groove depths d of the narrow grooves 9 can be adjusted as appropriate by adjusting the moving speed and/or the laser output during irradiation with the continuous wave laser. In addition, a part of the first surface 7*a* melted by the laser beam flows to the inlet side of the narrow groove 9 and solidifies, so that the first narrow grooves 9*a* with a narrow width of the inlet side can be formed. The head body 1A, such as FIG. 3 in which one or more narrow grooves 9 are formed on the first surface 7*a*, can be prepared.

In the second step, one or more prepreg sheets cut into a predetermined shape are laminated, for example. This gives the FRP member 1B in the form of a plate like as shown in FIG. 2.

Figure 8:
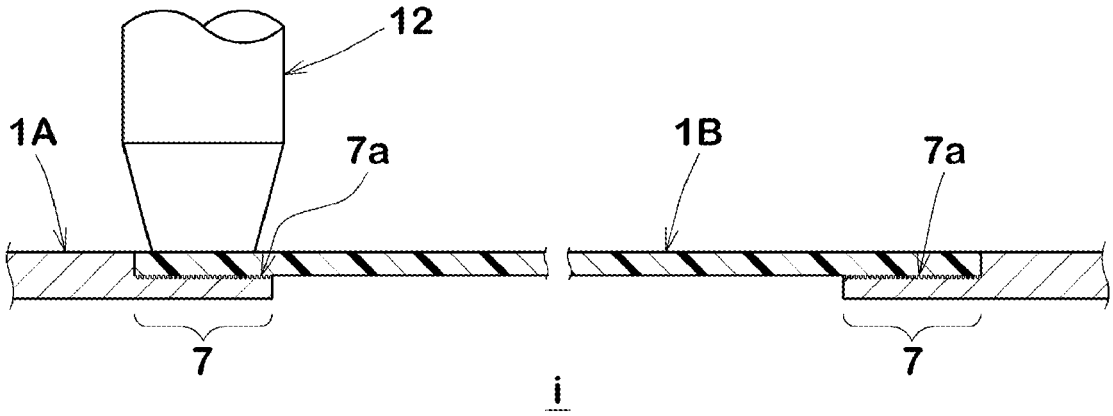
FIG. 8 is a cross-sectional view of a process of joining the support portion and the FRP member.

In the third step, as shown exemplary in FIG. 8, the peripheral edge portion of the FRP member 1B is superimposed on the first surface 7*a* of the support portion 7, and then the welding device 12 is pressed against the overlapping portion of both members to heat, and pressure is applied. As a result, the thermoplastic resin 10 of the FRP member 1B is plasticized and enters the inside of the narrow grooves 9 of the first surface 7*a*. After that, by cooling the head body 1A and the FRP member 1B, the thermoplastic resin 10 that has entered the inside of the narrow grooves 9 of the first surface 7*a* solidifies in it. As a result, the head 1 according to the present embodiment is manufactured.

In the third step described above, for example, a resistance spot welder, an ultrasonic welder head, etc. can be used for the welding device 12. In addition, pressurization may be performed with a die or the like, and heat energy may be separately applied by electromagnetic induction heating or the like.

Figure 9:
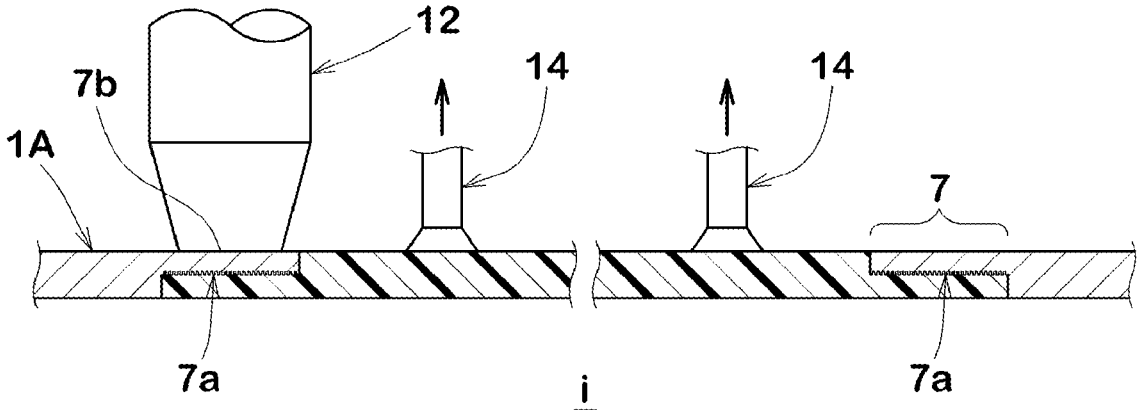
FIG. 9 is a cross-sectional view of a process of joining the support portion and the FRP member according to another embodiment.

In the embodiment shown in FIG. 8, the first surface 7*a* of the support portion 7 faces the outer surface of the head. In another embodiment, the first surface 7*a* may be on the inner surface side of the head facing a hollow portion i side. FIG. 9 shows the third step of the head of such an embodiment. In the third step of this embodiment, the FRP member 1B, for example, is lifted by a suction device 14 and pressed against the first surface 7*a*. In this state, heat is applied from a second surface 7*b* side of the support portion 7 by the welding device 12. In this third step, the suction device 14 was used to press the FRP member 1B against the first surface 7*a*. Alternatively, or together with the device, the FRP member 1B may be pressed against the first surface 7*a* of the support portion 7 by allowing high-pressure air or the like to act in the hollow portion i.

Figure 10:
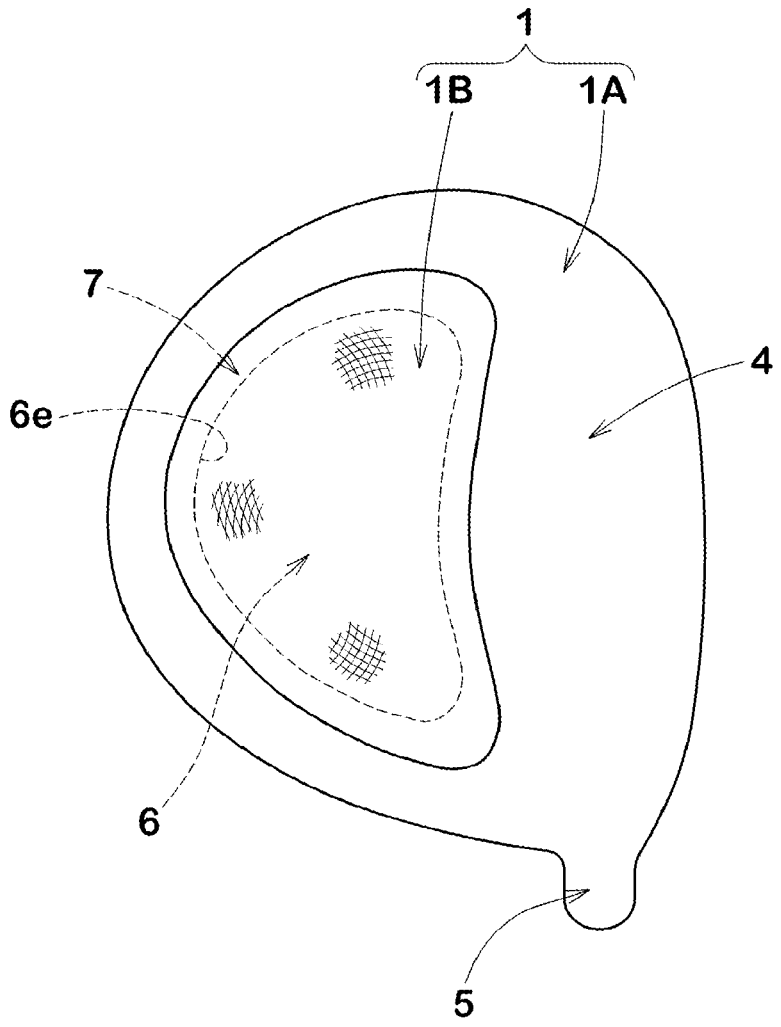
FIG. 10 is a bottom view of the golf club head according to another embodiment.

FIG. 10 shows a bottom view of the head 1 in accordance with another embodiment. As is clear from FIG. 10, in this embodiment, the opening 6 is formed on the sole 4 of the head body 1A, and the FRP member 1B is fixed to the sole 4 so as to close the opening 6. Such a head 1 can locate the center of gravity of the head higher and forward, but help to reduce the weight.

While the particularly preferable embodiments in accordance with the present disclosure have been described in detail, the present disclosure is not limited to the illustrated embodiments, but can be modified and carried out in various aspects within the scope of the disclosure.

[Additional Note]

This disclosure includes the following aspects.

[Note 1]

A golf club head comprising:

a metallic head body having an opening; and an FRP member fixed to the head body so as to close the opening, the FRP member being a fiber-reinforced plastic including fibers and thermoplastic resin, wherein the head body comprises a support portion around the opening, the support portion having a first surface for supporting the FRP member, the first surface is provided with at least one narrow groove having a groove width of 20 to 80 μm and a groove depth of 100 to 400 μm, and a part of the thermoplastic resin of the FRP member is solidified inside the at least one narrow groove.

[Note 2]

The golf club head according to note 1, wherein no adhesive intervenes between the FRP member and the first surface.

[Note 3]

The golf club head according to note 1 or 2, wherein the at least one narrow groove comprises a plurality of narrow grooves formed at an interval.

[Note 4]

The golf club head according to note 3, wherein the interval is in a range from 0.04 to 0.5 mm.

[Note 5]

The golf club head according to any one of notes 1 to 4, wherein the at least one narrow groove extends along a contour edge of the opening.

[Note 6]

The golf club head according to any one of notes 1 to 5, wherein the support portion has a support width measured in a direction orthogonal to a contour edge of the opening, and when the first surface is virtually divided into a first region on the contour edge side of the opening and a second region outside the first region by a width center line that divides the support width into two equal parts, an arrangement density of the at least one narrow groove in the second region is smaller than an arrangement density of the at least one narrow groove in the first region.

[Note 7]

The golf club head according to any one of notes 1 to 6, wherein the support portion has a thickness in a range from 0.5 to 1.2 mm.

[Note 8]

The golf club head according to any one of notes 1 to 7, wherein the first surface is recessed from an outer surface of the head body.

[Note 9]

The golf club head according to any one of notes 1 to 8, wherein the head body is made of a titanium alloy.

[Note 10]

The golf club head according to any one of notes 1 to 9, wherein the thermoplastic resin of the FRP member comprises polyphenylene sulfide, polyetherimide, polyethersulfone, polyetheretherketone or phenoxy.

[Note 11]

The golf club head according to any one of notes 1 to 10, wherein the head body comprises a crown and a sole, and the opening is provided on the crown and/or the sole of the head body.

The invention claimed is:

1. A golf club head comprising:

a metallic head body having an opening; and an FRP member fixed to the head body so as to close the opening, the FRP member being a fiber-reinforced plastic including fibers and thermoplastic resin, wherein the head body comprises a support portion around the opening, the support portion having a first surface for supporting the FRP member, the first surface is provided with at least one narrow groove having a groove width of 20 to 80 mm and a groove depth of 100 to 400 mm, no adhesive intervenes between the FRP member and the first surface, and a part of the thermoplastic resin of the FRP member is solidified inside the at least one narrow groove.

2. The golf club head according to claim 1, wherein the at least one narrow groove comprises a plurality of narrow grooves formed at an interval.

3. The golf club head according to claim 2, wherein the interval is in a range from 0.04 to 0.5 mm.

4. The golf club head according to claim 1, wherein the at least one narrow groove extends along a contour edge of the opening.

5. The golf club head according to claim 2, wherein the support portion has a support width measured in a direction orthogonal to a contour edge of the opening, and when the first surface is virtually divided into a first region on the contour edge side of the opening and a second region outside the first region by a width center line that divides the support width into two equal parts, an arrangement density of the plurality of narrow grooves in the second region is smaller than an arrangement density of the plurality of narrow grooves in the first region.

6. The golf club head according to claim 1, wherein the support portion has a thickness in a range from 0.5 to 1.2 mm.

7. The golf club head according to claim 1, wherein the first surface is recessed from an outer surface of the head body.

8. The golf club head according to claim 1, wherein the head body is made of a titanium alloy.

9. The golf club head according to claim 1, wherein the thermoplastic resin of the FRP member comprises polyphenylene sulfide, polyetherimide, polyethersulfone, polyetheretherketone or phenoxy.

10. The golf club head according to claim 1, wherein the head body comprises a crown and a sole, and the opening is provided on the crown and/or the sole of the head body.

11. The golf club head according to claim 1, wherein the support portion has a support width Ws measured in a direction orthogonal to a contour edge of the opening, and the support width Ws is equal to or more than 3 mm.

12. The golf club head according to claim 1, wherein the support portion has a support width Ws measured in a direction orthogonal to a contour edge of the opening, and the support width Ws is equal to or less than 13 mm.

13. The golf club head according to claim 1, wherein the at least one narrow groove comprises at least one first narrow groove in which a groove width on a groove bottom side is greater than a groove width on an inlet side in a groove depth direction.

14. The golf club head according to claim 1, wherein the at least one narrow groove is continuous in a loop shape and follows a contour edge of the opening around a periphery of the opening.

15. The golf club head according to claim 1, wherein the at least one narrow groove comprises a plurality of narrow grooves, and the plurality of narrow grooves is arranged concentrically along a contour edge of the opening.

16. The golf club head according to claim 1, wherein the at least one narrow groove extends spirally and follows a contour edge of the opening around a periphery of the opening.

* * * * *